United States Patent [19]

Lancaster

[11] Patent Number: 5,031,771

[45] Date of Patent: Jul. 16, 1991

[54] ROPED STRETCH WRAPPING SYSTEM

[75] Inventor: Joseph R. Lancaster, Louisville, Ky.

[73] Assignee: Lantech, Inc., Louisville, Ky.

[21] Appl. No.: 347,063

[22] Filed: May 4, 1989

Related U.S. Application Data

[60] Division of Ser. No. 186,348, Apr. 26, 1988, Pat. No. 4,845,920, which is a continuation of Ser. No. 817,149, Jun. 3, 1986, Pat. No. 4,754,594, which is a continuation of Ser. No. 125,275, Feb. 27, 1980, abandoned.

[51] Int. Cl.[5] ..... B65D 71/02

[52] U.S. Cl. ..... 206/442; 53/399; 53/441; 206/597

[58] Field of Search ..... 53/399, 441, 461, 556, 53/587, 588; 206/386, 597, 442

[56] References Cited

U.S. PATENT DOCUMENTS

| | | | |
|---|---|---|---|
| 3,986,611 | 10/1976 | Dreher | 53/441 |
| 4,077,179 | 3/1978 | Lancaster et al. | 53/441 |
| 4,204,377 | 5/1980 | Lancaster et al. | 53/441 |
| 4,232,501 | 11/1980 | Stackhouse | 53/441 |
| 4,235,062 | 11/1980 | Lancaster III, et al. | 53/441 |
| 4,255,918 | 3/1981 | Lancaster et al. | 53/556 |
| 4,271,657 | 6/1981 | Lancaster III, et al. | 53/441 |
| 4,754,594 | 7/1988 | Lancaster | 53/399 |
| 4,845,920 | 7/1989 | Lancaster | 53/441 |

FOREIGN PATENT DOCUMENTS

| | | | |
|---|---|---|---|
| 2522113 | 11/1976 | Fed. Rep. of Germany | 206/597 |

*Primary Examiner*—Jimmy G. Foster

*Attorney, Agent, or Firm*—Finnegan, Henderson, Farabow, Garrett & Dunner

[57] ABSTRACT

The present invention comprises a wrapping apparatus having a frame, a reciprocally driven carriage moveably mounted on the frame, the carriage being adapted to hold a rotatable roll of stretchable film material and a film width varying mechanism. A driven rotatable turntable adapted to support a load is positioned adjacent to the frame, and the leading edge of the film material is held adjacent the load. A brake is connected to the film roll to restrict movement of the web of material from the roll and the film width varying mechanism is mounted in the material path so that the film web travels through a pivotable "C" shaped assembly of the film width varying mechanism to collapse the film web width so that the web edges are formed into rope configurations connected by a membrane of film. The carriage is driven along the frame in one direction to provide a wrap, stops when the sensing mechanism on the carriage indicates that a junction between units on the load is present to deposit the stretched collapsed film web so that each roped edge is placed on an adjoining vertically positioned unit with the membrane connecting the two units. The carriage carries the film roll to the next or subsequent junctions where the wrap cycle is repeated until the package wrap is complete, at which time the material web is severed from the material roll dispenser.

6 Claims, 4 Drawing Sheets

ROPED STRETCH WRAPPING SYSTEM

RELATED APPLICATIONS

This application is a division of application Ser. No. 186,348, filed Apr. 26, 1988, now U.S. Pat. No. 4,845,920, which is a continuation of application Ser. No. 817,149, filed June 3,1986, U.S. Pat. No. 4,754,594, which is incorporated herein by reference and which is a continuation of application Ser. No. 125,275, filed Feb. 27, 1980 now abandoned, which is also incorporated herein by reference.

BACKGROUND OF THE INVENTION

The present invention generally relates to packaging and more particularly to a process for making unitary packages which hold a plurality of components, each package containing a load wrapped in a web of stretched collapsed film which forms a Z-shaped net-like configuration on the load.

Case packing or boxing is a common way of shipping multiple unit products. The multiple unit products are generally stacked in a corrugated box or are wrapped with kraft paper with the ends of the kraft paper being glued or taped. Another way of shipping such products is by putting a sleeve or covering of heat shrinkable film around the products and shrinking it to form a unitized package. The use of heat shrinkable film is described in U.S. Pat. Nos. 3,793,798; 3,626,654; 3,590,509; and 3,514,920. A discussion of this art is set forth in U.S. Pat. No. 3,867,806.

The present invention provides a simple and reliable process for wrapping a load of stacked multiple unit products into a single wrapped package load by using a single strand of stretched overwrap material formed into a specifically shaped configuration around the load allowing the contents of the load to breathe.

When the present process is compared with other processes currently used to pack products in corrugated boxes and the cost of the corrugated boxes themselves, the invention shows an enormous cost savings. In addition to these factors the invention uses stretch. film material, which is less expensive than netting material or perforated stretch film and which also provides product visibility not possible with kraft or corrugated wrapping plus the desirable feature of letting the load "breathe." This feature is especially desirable when live product is packaged and shipped. In addition to the feature of breathability, many current products shipped on pallets need special consideration for product preservation. The areas of most concern are products that need refrigeration, products produced and packaged hot that need to cool at ambient temperature without trapping moisture such as baked goods, chemically treated material that needs to release the chemicals before sale such as surgical gloves and anesthetics and products packaged and cooled rapidly, such as ice cream, yogurt and frozen turkeys. Most manufacturers and shippers of such products need a method of unitizing a pallet load of material, while retaining the properties of ventilation and breathability. Manufacturing operations handling such products function more efficiently if pallet loads are unitized immediately off the production line, before temperature adjustment or the release of gas and moisture. Due to the problems inherent in these specialized manufacturing operations only certain methods of unitization have been found to be acceptable.

In order to retain the required properties of shipping and breathability, various methods have been used which have associated problems.

Some manufacturers use strapping of vertical steel or plastic binding to unitize the product. The problems incurred in the use of strapping are the requirement of costly corner protectors, danger of bending or snapping and injuring the operator while applying this high tension material on the loads and the ever present problem of settling due to moisture wetting the cartons and the sides bulging or normal vibrations causing the straps to loosen and the load to come apart.

Glue is an alternative method used in some areas but customer dissatisfaction with gluing is high because of the problem that taking cartons or bags off the unitized load tends to tear outside layers of the cartons. Glue, although an inexpensive material, requires interleaving for product orientation requiring more durable and expensive packaging material.

Because of the lack of alternatives of packaging, tape is being used to horizontally bind the top layer of the load. However, tape is expensive and allows relatively free movement of all product surrounded.

Stretch netting per se does an excellent job of unitizing and offers breathability but has sealing problems and the cost per load, at present, is equal if not more expensive than present methods, especially in produce and refrigerated ice products areas.

Some manufacturers do not place unitizing material on their stacked loads. Damage of the loads in shipment and customer dissatisfaction is high with such procedures.

In summary, shippers of specialty items that need load environmental considerations have been forced to pay high prices that are passed on to the consumer or incur multiple damage to the load with all presently used modes of unitization. Stretch wrap cannot be used since the film itself places a barrier between the product and the surrounding area, aiding in the over-ripening, deterioration or high cool down time of these specially treated products.

As an alternative to the aforementioned processes the present inventive process offers packaging speed, reliability of package seal and energy savings in that less energy is required to package the products.

A problem with shrink and cling stretch film packaging, in addition to the fact that the film does not allow a load to breathe is that the primary strength and reliability of the package is determined by the consistent quality of the seal. These seals depend on a careful maintenance of the sealing jaw and are never as strong as the film itself. The time that it takes to make the seals is a limiting factor on the possible speeds of most shrink systems with the additional problem that some stretchable materials, as for example, stretch netting, or narrow film widths cannot be effectively heat sealed.

The present invention uses spiral wrapping machinery to apply the film web to the load in the inventive process.

The use of spiral wrapping machinery is well known in the art. One such apparatus is shown by U.S. Pat. No. 3,863,425 in which film is guided from a roll and wrapped around a cylindrical load in a spiral configuration. A carriage drives the film roll adjacent the surface of the load to deposit a spiral overwrap around the load and returns in the opposite direction to deposit another spiral overwrap around the load. Other spiral wrapping apparatus are described by U.S. Pat. Nos. 3,857,486; 3,549,017; 3,412,524; 3,191,289 and 2,716,315.

It has previously been disclosed in U.S. Pat. No. 3,788,199 to spirally wind tapes in a manner that they overlap each other to provide suitable space there between when breathability is required. In this reference, a heavy duty bag is prepared by spirally winding stretched tapes of synthetic resin in opposite directions, so that they intersect each other to form a plurality of superimposed cylindrical bodies which are bonded together to form a cylindrical network. The spirally wound inner and outer tapes of the super-imposed cylindrical body intersect each other at a suitable angle, depending upon the application intended, the preferred embodiment having substantially equal longitudinal transfer strength. In this preferred embodiment the tapes intersect each other an an angle of about 90°. The angle defined by the tapes constituting the cylindrical network may be determined by varying the interrelationship between the travelling speed of the endless belts carrying the tape and the rotating speed of the bobbin holders, which rotate a plurality of tape bobbins to deposit the tape onto the moveable belt. The previously indicated patents rely on heat shrink material, adhesives, a heat seal or the tacky nature of the film to hold the outer layer of wrap in a fixed position.

The turntable clamping assembly described in this specification is disclosed in U.S. Pat. No. 4,077,179. Various patents have described the use of mechanisms for wrapping materials. In U.S. Pat. No. 3,003,297 a complex cutting and holding mechanism is used to place tape on a box and cut it off with the process being repeated for each box.

U.S. Pat. No. 2,088,133 discloses a reverse wrapping wire tying machine. In the reference a gripper mechanism holds a band in position with respect to the load to be wrapped and a rotatable ring drive rotates the band around the load until the band has completed more than one wrap of the load and passes over the body of the gripper mechanism. A separator slide is used to separate the leading edge of the band from the underlying band and a second gripper mechanism attaches to the separate band. A heat sealing mechanism welds the wrapped layer band to the band underneath it and a cutting mechanism severs the leading edge of the band held by the second gripper mechanism which then becomes the trailing edge of the succeeding wrap. When the band is severed the ring drive mechanism is rotated in a reverse direction for the following load with the various gripping and cutting mechanisms functioning in the same manner.

Additional references of interest which are pertinent to rotatable drives for wrapping packages are disclosed in U.S. Pat. Nos. 3,820,451; 3,331,312; 3,324,789; 3,309,839; 3,207,060; 2,743,562; 2,630,751; 3,330,629; 2,054,603; and 2,124,770.

Other applications in packaging are shown by U.S. Pat. Nos. 3,514,920 and 3,793,798 in which heat shrink film is wrapped around a pallet supporting a plurality of cartons. A similar full web apparatus using a tensioned cling film is shown by U.S. Pat. No. 3,986,611 while another apparatus using a tacky PVC film is disclosed in U.S. Pat. No. 3,795,086.

The present invention uses stretchable plastic film in its preferred embodiment since the mechanical stretching of the film utilizes its strength better than heat shrink wrap and at less cost than netting, and can be used on loads where breathing is necessary or no heat can be applied to the product. The elasticity of the collapsed film holds the products under more tension than either shrink wrap or kraft wrap particularly with products which settle or relax when packaged.

It can thus be seen that the problem has been attempted to be solved by various methods and operations, none of which have been entirely satisfactory.

SUMMARY OF THE INVENTION

The present invention generally relates to the packaging of a load holding a plurality of units and is particularly directed toward providing a package wrap around a stacked load which allows the load to have breathability and positive load security.

A film web dispensed by the film roll is collapsed by a mechanical device that forms the film web into two ropes on the top and bottom edges of the film web. Between these top and bottom ropes of bunched film is a membrane of film which connects the ropes. The collapsed configuration of film which is significantly reduced from its original width is applied to the load at specific spots and is precisely located with the ropes since they are a concentrated band of film grabbing onto and digging into the outside of the packages of product. The collapsed web is applied at the joining point of two layers of product with one rope being placed on the overlying product and the other rope being placed on the underlying product to unitize each layer of product with the membrane of film between the two ropes securing each layer to another to prevent destruction of the load by horizontal "shear" forces and vertical forces caused by jolting, bouncing and settling.

The pattern of film transfer from layer to layer on the load forms a Z-type configuration on one side of the load. The web ropes add to the basic stability of the load while concentrating a containing force in the areas where it is needed. The spaced package wrap allows the transfer of heat, moisture, air and gases into the surrounding environment, and selectively unitizes the layers together by applying containing force at the critical junction areas of the load. The dual roping of the web binds each layer and grips each layer by indenting the package material and the timing of the apparatus provides precise film coverage with equal force on all sides of the load resulting in a significant lowering of costs by using less film than that quantity of film currently used in existing wrapping processes.

The present invention does not require a structural seal and therefore can use any type of stretchable material. The invention is designed to function with stretchable film webs such as nylon, polypropylene, PVC and polyethylene which can be stretched in small widths with less force than that required to stretch stretchable net. In addition, the cost of such film webs is less expensive than the costs which are found with current stretch net film.

Thus it can be seen that a significant economic factor is present in the invention, as the power requirements are significantly less than those of shrink systems since there is no heat tunnel required, and greater speeds of operation are possible because of the elimination of the requirement for overlapping helical layers of spiral wrap. Furthermore, a wider number of products can be handled with the present invention because of its breathability aspects, and due to the simplicity of the construction of the invention, there is a greater stability in the inventive wrapping apparatus and processes with less maintenance being required to maintain the apparatus resulting in a corresponding reduction in breakdown time.

The above-mentioned purposes and operations of the invention are more readily apparent when read in conjunction with the following description of the drawings and detailed description of the preferred embodiment of the present invention.

DETAILED DESCRIPTION OF THE DRAWINGS

Figure 6:
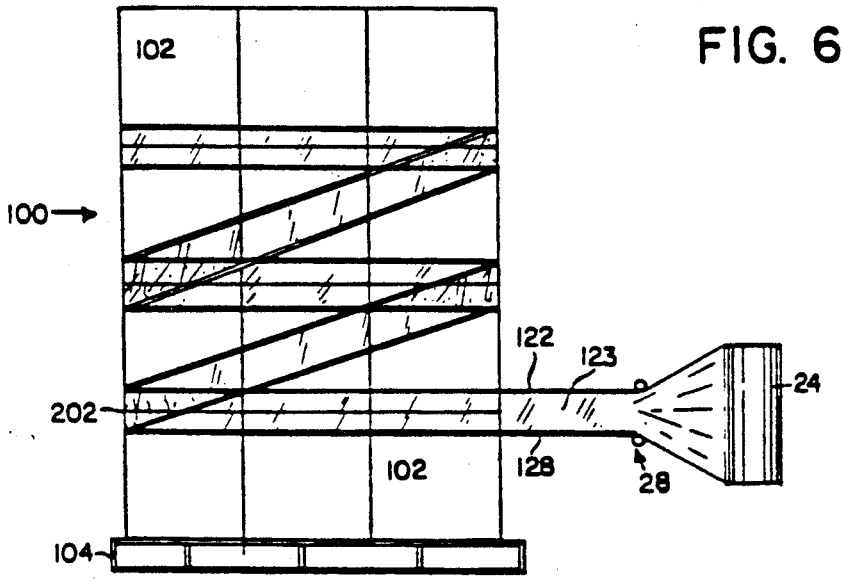
FIG. 6 is a side elevational view of a load wrapped in accordance with the inventive process.

The spiral wrapping apparatus 10 is most clearly shown in FIGS. 1 through 4 with the wrapped load being shown in FIG. 6.

The spiral wrapping apparatus 10 comprises an upright frame 12 sitting on a base 13. Such stretch wrapping machines are well known in the art and are typified by machine Model Nos. SVS-80, SVSM-80, STVS-80, STVSM-80 and SASH-80 manufactured by Lantech Inc.

Figure 2:
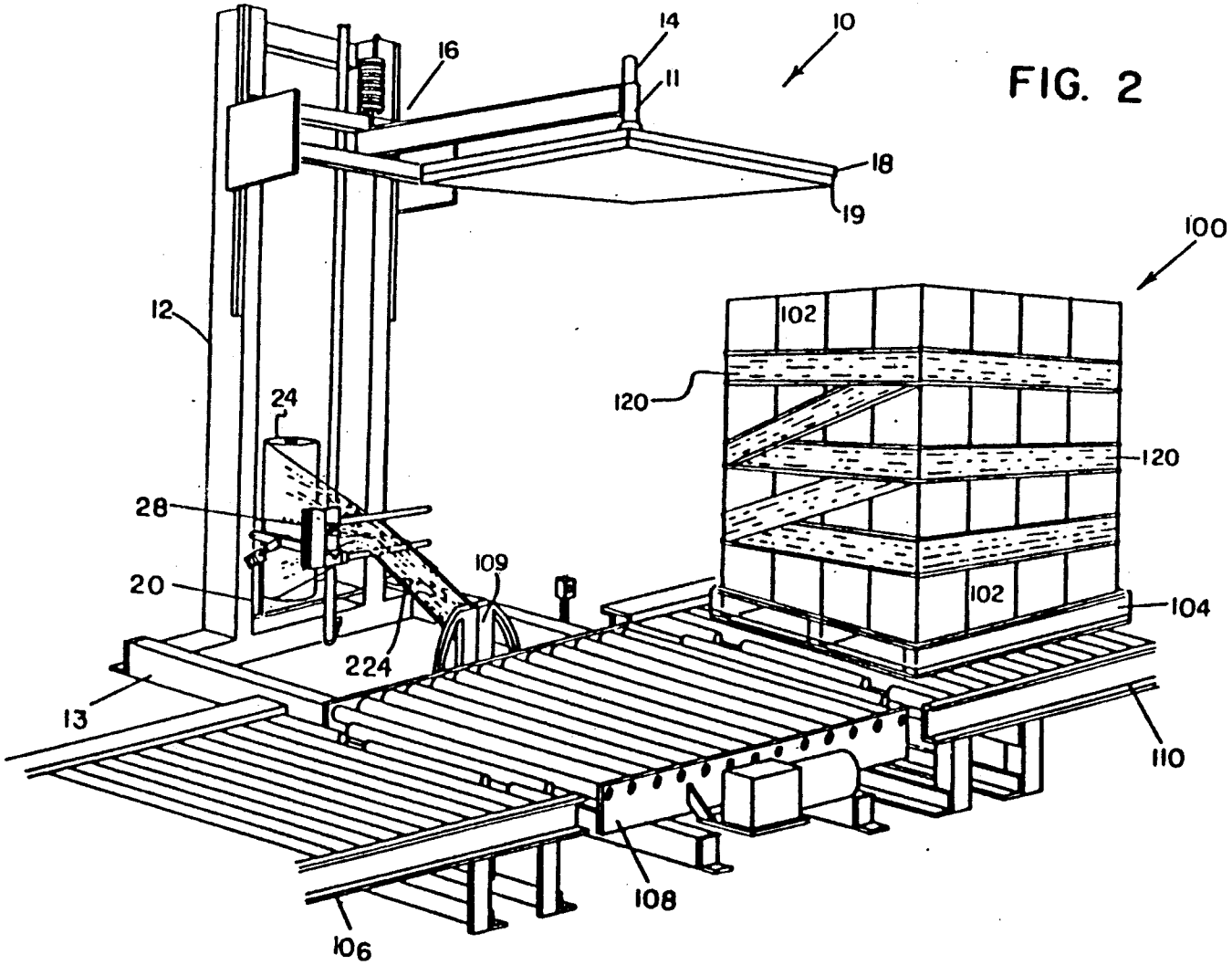
FIG. 2 is a perspective view of a spiral wrapping machine used with a film web collapsing mechanism to perform the inventive process.

The preferred embodiment shown in FIG. 2 is provided with a platen assembly 14 mounted on the frame 12 for movement along the frame. The platen assembly comprises a support structure 16 moveably mounted to the frame and a platen 18 moveably mounted to the support structure. The platen has a flexible lower surface 19 which is adapted to be placed on the top of a load 100 comprising a plurality of unitary members 102 stacked on a pallet 104. The lower surface of the platen is lowered onto the top of the load 100 after the load is carried by power conveyor 106 onto the powered turntable 108.

When turntable **10*d* is rotated by a motor the platen rotates within journal 11 of the platen assembly holding the units in position on the load as the wrap 120 is stretch wrapped around the load. The platen provides a force on the units 102** to prevent the units from being displaced or pulled from the load as the stretched film material is wrapped around the load.

Figure 4:
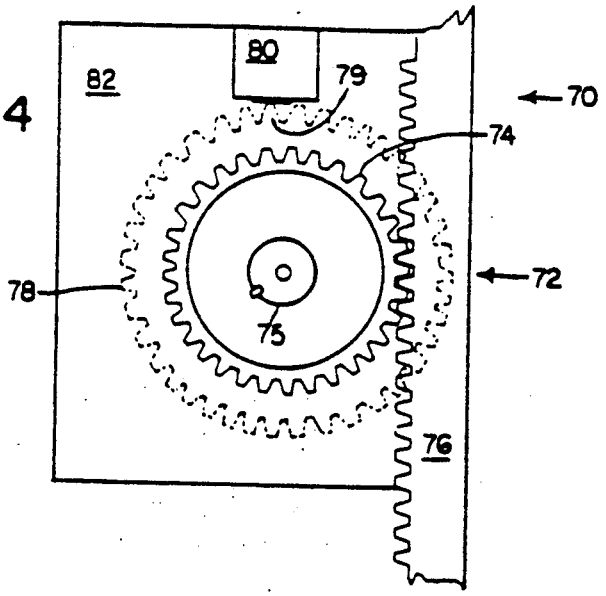
FIG. 4 is a side elevational view partially in phantom of the rack drive mechanism of the spiral wrapping machine with a pinion gear movement sensing device.
Figure 1:
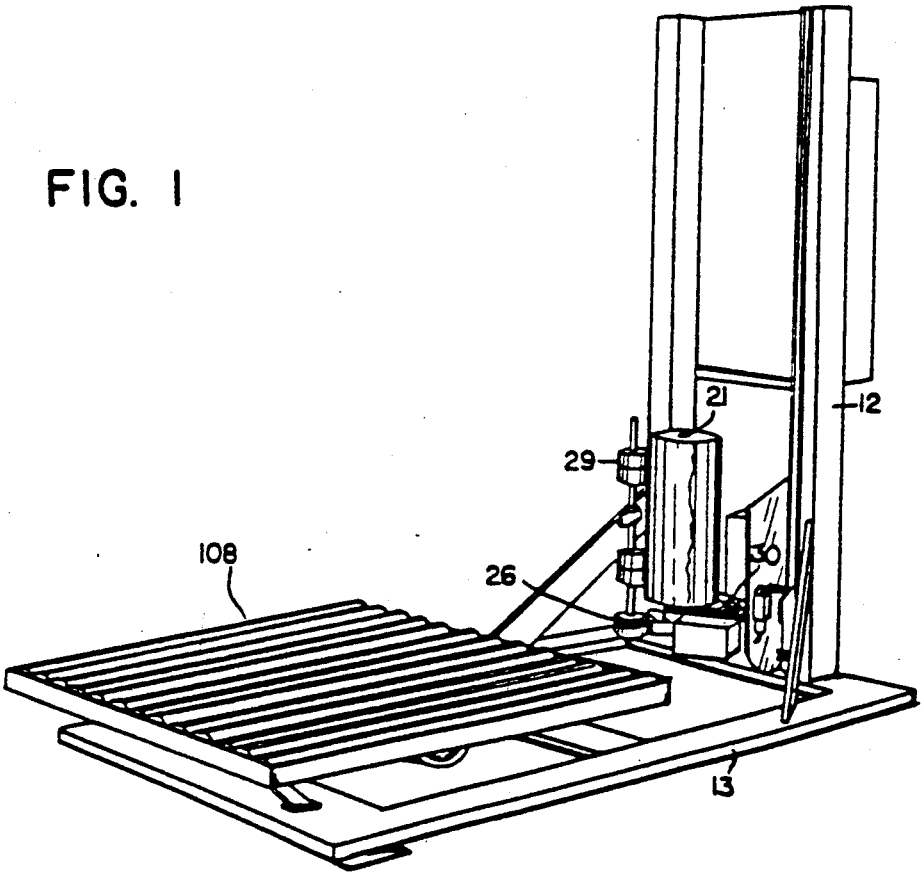
FIG. 1 is a perspective view of a typical isolated spiral wrapping machine used to perform the inventive process.

A film roll support or carriage 20 is moveably mounted on the frame 12. The film roll carriage includes a film collapsing mechanism 28 which is not shown in FIG. 1 and a film roll mandrel or vertical holding member 21 which holds a roll of film 24 of either a nylon, polypropylene , PVC or other suitable composition from 6" to 20" in width. The film roll carriage can be mounted in guides or tracks in the frame and is preferably driven by a rack and pinion drive as shown in FIG. 4. However, alternative drives such as chain, screw or other known drives could be readily adapted to the invention. The film roll is restricted by the action of a magnetic particle brake 26 as shown in FIG. 1 which applies a restrictive force on the film roll subjecting the film material to a braking force causing it to stretch as it is wrapped around the load. The restrictive force is preferably applied by utilizing a roller assembly 29 to engage the outside of the film roll and supply a constant force on the film roll uniformly stretching the film web as it leaves the roll.

Figure 3:
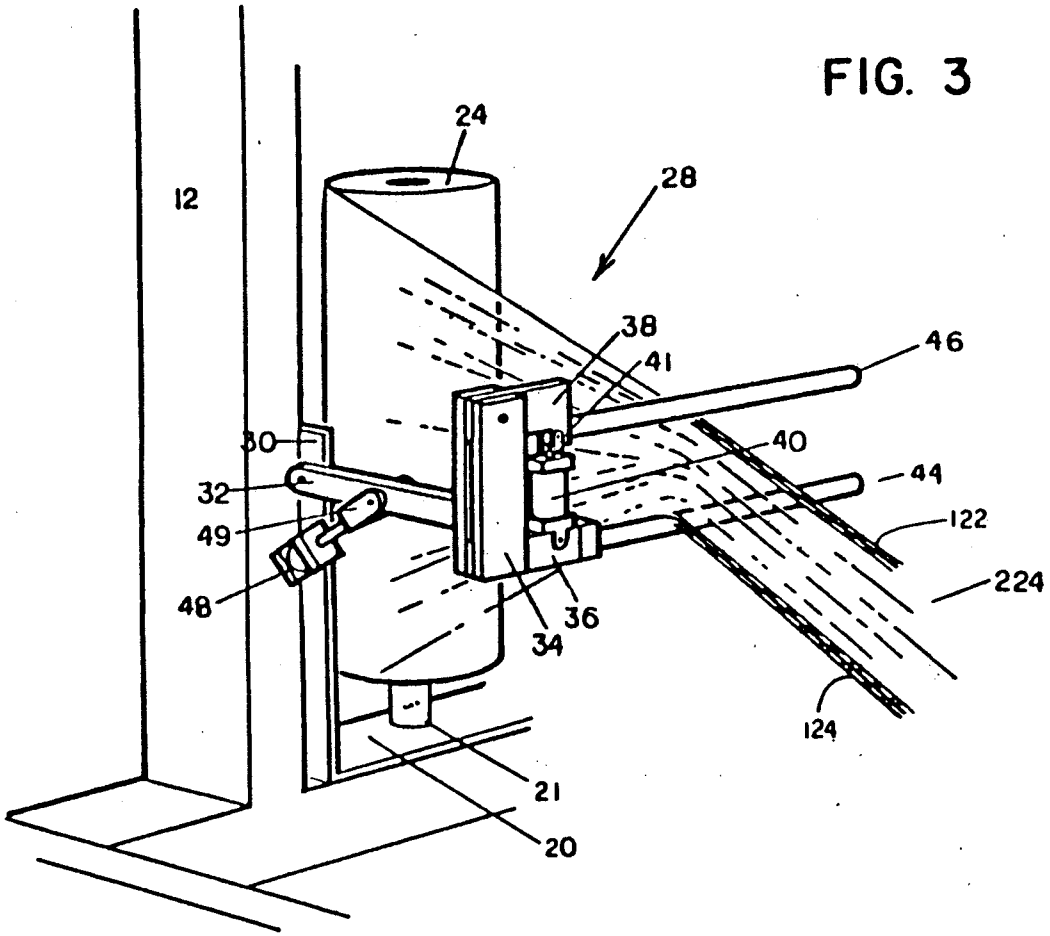
FIG. 3 is an enlarged perspective view of the web collapsing apparatus on the apparatus of FIG. 2.
Figure 5:
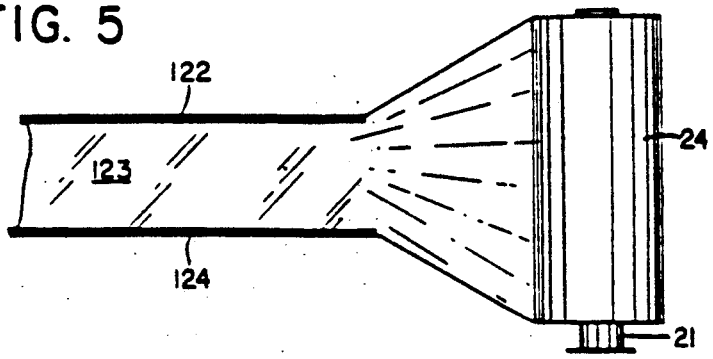
FIG. 5 is a side elevational view of the film web roped at each edge for wrapping around the load.

It should be noted that film, film web and film material are used interchangeably throughout the specification. Typical films which can be used in the stretch wrapping apparatus are EVA copolymer films with a high EVA content, such as the film manufactured by Consolidated Thermoplastics, "RS-50", Bemis "Super-Tough" and PPD "Stay-Tight" films. PVC films such as Borden Resonite PS-26 can be used in the invention along with premium films such as Mobil-X, Presto Premium and St. Regis which utilize a new low pressure polymerization process resin manufactured by Union Carbide and Dow/Corning Chemical Company. This resin, called linear low density polyethylene, has significantly different stretch strength characteristics than previous stretch films. These characteristics allow the film to withstand the high stress of extreme elongation without tearing during wrapping of the pallet. As the film comes off of the roll 24 it is stretched by the brake 26 restricting the rotation of roller assembly 29 and passed through a film collapsing mechanism 28. The film collapsing mechanism which is best shown in FIGS. 2 and 3 comprises a support plate 30 secured to the carriage and slidably mounted on frame 12 or carried by the carriage and a rotatable support bar 32 having one end rotatably mounted to the support plate 30 and the other end being secured to a support block 34. The support block 34 has a stationary leg 36 secured to it and a rotatable leg 38 rotatably mounted to the block above the stationary leg. A fluid activated cylinder 40 is mounted to the stationary leg 36 with a yoke end 41 of its piston rod being connected by pin means to the rotatable leg 38. A linear rod 44 is secured to the stationary leg 36 and a similarly shaped moveable rod 46 is secured to the moveable rotatable leg 38.

A fluid activated cylinder 48 is secured to support plate 30 and has a yoke end 49 of its piston rod connected to rotatable support bar 32. Thus cylinder 48 can be energized by known fluid circuitry to move the block 34 and its associated rods 44 and 46 up and down in a plurality of positions to engage the film web. The cylinder 40 is energized to move the rotatable leg 38 and its associated rod 46 in an approximately 90° arc out of the path of the film, if the film collapsing mechanism is desired to be removed from the film path. The film collapsing mechanism 28 is used to collapse the film width so that the edges are formed into two ropes 122 and 124, top and bottom, on the web of film. Between these two ropes 122 and 124 is an unroped membrane of film 123 which connects the ropes. The configuration of the film web which was preferably originally ten inches in width, is collapsed two to five inches wide, and applied to the load at specific spots. The ropes 122 and 124 since they are concentrated bands of film, grab onto and dig into the outside surface of package 102 of the load. This force is the foothold created by the indentation and secures the load. The location where the two ropes and membrane of the collapsed web are placed at the junction of two units is critical to the packaging of the load. This placement is applied at the junction point 202 of the two layers of product where one package or carton 102 is placed on top of the other.

In another embodiment the film collapsing mechanism is in the form of a rotatable sectioned funnel constructed to engage the film web edges with the width of the film gradually being diminished to bunch the film edges as it is transported through the funnel mechanism. However, it will also be appreciated that the film collapsing mechanism can be moved into and out of the film path so that a wrapping cycle can be initiated wherein a part of the load is wrapped with a stretched non-collapsed film web.

The placement of the collapsed web on the load is accomplished through the use of a control mechanism 70 which is shown in FIG. 4 of the drawings. The control mechanism 70 utilizes the rack and pinion film elevator drive 72 which raises and lowers the carriage as the load is wrapped. A positive gear 74 to rack 76 drive provides an efficient and dependenable method of film elevator control requiring minimum maintenance and adequate distance controls. A sprocket 78 shown in phantom is mounted to the pinion gear shaft 75 and rotates past a sensor device 80 mounted on the gear housing 82. The sensor device 80 which can be a standard metal detection device which is well known in the art senses the teeth 79 of the sprockets as they pass by and counts them using standard counting circuitry which is also well known in the art to determine the distance of travel up or down the rack by the carriage. While a magnetic sensor 80 is preferably used to sense the ferrous content of the sprocket teeth and send pulses which change to electrical signals, optical scanning devices can be used, as for example photocells, which are in the scope of the invention.

Since the wrap cycle starts at the bottom or the top of the load, a prior determination is made regarding the distances to the junctions between the carton layers so that as distance is counted by the sensor 80, one or more collapsed wraps may be wrapped around junction 202 between the units 102 before the carriage is carried upward to the next junction between packages where it stops its vertical travel and wraps the junction and associated cartons. During the entire wrap the turntable 108 is continuously rotated. It can thus be seen from FIG. 6 that the wrap forms a substantially Z-shaped configuration as it wraps horizontally between the junction of the units an traverses upwardly or downwardly as the load is rotated and the carriage travels between the junctions of the cartons.

In operation of the apparatus 10 the load 100 is moved onto the turntable 108 by power conveyor 106. The turntable is then rotated by an appropriate driving mechanism which is well known in the art and braking force is applied to the web of collapsed stretchable material causing it to be substantially stretched above 10 percent. In the initial cycle the end of the stretched film web is placed between the turntable clamps 109 or manually pulled through the film collapsing mechanism 28 and placed between the turntable clamps.

When the web collapsing mechanism is brought in to engagement with the film web 224 the web is reduced in width to form roped edges 124 and 126 with an interconnecting membrane 123. The operator having previously determined the height of the unit cartons, has preset the drive of the carriage so that it will proceed up a distance sufficient to allow each roped edge to engage one of the adjacent units with the membrane between the roped edges of the film web covering the junction 202 between the vertical units. Each time the sensor 80 and associated sensor mechanism 70 determines that the pinion gear 74 has travelled up the rack a predetermined distance, the carriage drive stops and the rotating load causes one or more layers of roped web to be deposited along the junction of the next higher carton and underlying carton. Thus, the load is contained together by two ropes with a concentrated force. One rope is placed on one layer of units and the other rope is placed on the other layer of units with a unitary membrane connecting the two ropes. The ropes are used to unitize each layer of the product while the membrane of the film web secures each layer to the other layer preventing destruction of the load by horizontal shear forces and vertical forces, caused by jolting, bouncing and settling. The concentration of the force of the film web on the load exactly where the forces are required eliminates the possibility of unequal forces that tend to destroy and not unitize the load. By wrapping all four sides of the load with equal forces the transfer of the film web from one layer to another has no ill effects on the stability of the load. After sufficient film has been placed around the load, the cycle is finished and the film end is either secured mechanically or manually onto the unitized load by heat sealing, mechanical closure apparatus, or simply through the use of a tacky film.

In an alternate mode of operation, the carriage can be programmed to stop at alternate carton junctions in one direction wrapping them in the manner discussed and when returned in the opposite direction wrap those junctions which had been skipped in the first directional wrap.

It should be noted that the steps of the wrapping process can be interchangeable without departing from the scope of the invention. Furthermore, these steps can be interchanged and are equivalent.

Thus, the film web can be deposited only in one direction up or down the load or can be deposited up and down the load.

It should be understood that the examples set forth are not meant to limit the invention in any manner nor is the invention limited to any one embodiment described herein. On the contrary, uses intended to cover all alternatives, modifications and equivalents may be included within the spirit and scope of the appended claims.

What is claimed is:

1. A unitized load comprising:

successive multi-unit layers with the layers stacked to form an array extending in a longitudinal direction with junctions extending in a lateral direction between the successive layers; and a tensioned web having roped edges of collapsed web material and a central unroped portion of web material connecting the roped edges, the web being wrapped around the load over the junctions while being in substantial orientation with the junctions, covering the junctions with the unroped central portion of the web and grabbing the successive layers with the roped edges to hold the successive layers together and to hold the units of each layer together.

2. The unitized load of claim 1 wherein the wraps of web around successive junctions are connected by an intermediate web portion.

3. The unitized load of claim 2 wherein the intermediate web portion is diagonally positioned between the wraps of web to form a substantially "Z" shaped configuration.

4. A unitized load comprising:

successive units stacked in a longitudinal direction with junctions extending in a lateral direction between the successive units; and a tensioned web having roped edges of concentrated web material and a central unroped portion of web material connecting the roped edges, the web being wrapped around the load over the junctions while being in substantial orientation with the junctions, covering the junctions with the unroped central portion of the web, and grabbing the successive units with the roped edges to hold the successive units together.

5. The unitized load of claim 4 wherein the wraps of web around successive junctions are connected by an intermediate web portion.

6. The unitized load of claim 5 wherein the intermediate web portion is diagonally positioned between the wraps of web to form a substantially "Z" shaped configuration.

* * * * *